US012404648B2

(12) United States Patent
Kundel, Sr.

(10) Patent No.: US 12,404,648 B2
(45) Date of Patent: Sep. 2, 2025

(54) TRENCH BOX INCLUDING MODULAR PANELS AND METHOD OF USE THEREOF

(71) Applicant: Kundel Industries, Inc., Vienna, OH (US)

(72) Inventor: Robert Kundel, Sr., Cortland, OH (US)

(73) Assignee: Kundel Industries, Inc., Vienna, OH (US)

( * ) Notice: Subject to any disclaimer, the term of this patent is extended or adjusted under 35 U.S.C. 154(b) by 449 days.

(21) Appl. No.: 17/933,173

(22) Filed: Sep. 19, 2022

(65) Prior Publication Data

US 2024/0093456 A1 Mar. 21, 2024

(51) Int. Cl.
*E02D 17/08* (2006.01)

(52) U.S. Cl.
CPC ..... *E02D 17/08* (2013.01)

(58) Field of Classification Search
CPC ..... E02D 29/0266; E02D 29/0233; E02D 2600/30
See application file for complete search history.

(56) References Cited

U.S. PATENT DOCUMENTS 1,794,704 A * 3/1931 Miller ..... E02D 29/02 405/282
1,880,316 A * 10/1932 Dancer ..... E02D 17/08 405/272
2,808,624 A * 10/1957 Sullivan ..... E04B 1/6125 52/584.1
2,865,178 A * 12/1958 Wicke ..... E02D 17/086 405/283
3,750,410 A * 8/1973 Converse ..... E02D 17/08 405/272
4,033,138 A * 7/1977 Griswold ..... E02D 17/08 403/167
4,685,837 A * 8/1987 Cicanese ..... E02D 17/08 405/282
5,902,075 A * 5/1999 Krings ..... E02D 17/08 405/251
7,021,868 B1 * 4/2006 Farrag ..... E02D 17/00 405/282
10,501,906 B2 * 12/2019 Spry ..... E02D 17/083
11,834,804 B1 * 12/2023 Malloy ..... E02D 17/08

* cited by examiner

*Primary Examiner* — Kyle Armstrong
(74) *Attorney, Agent, or Firm* — Sand, Sebolt & Wernow Co., LPA

(57) ABSTRACT

A trench box including a first plate to support a first side of a trench, a second plate to support a second side of a trench, and spreader bars extending between the first and second plates. One or both of the first and second plates is assembled from a plurality of modular panels arranged in a same plane and detachably secured to one another by a plurality of connectors and fasteners. A panel may be removed from one of the first plate and/or the second plate when an obstacle is encountered in the ground that runs across the trench. The removal of the panel creates an opening in the trench box to accommodate the obstacle without compromising the structural integrity of the trench box. Removal of the panel also does not negatively impact the trench box's ability to prevent collapse of the sides of the trench into the trench.

20 Claims, 14 Drawing Sheets

TRENCH BOX INCLUDING MODULAR PANELS AND METHOD OF USE THEREOF

TECHNICAL FIELD

This disclosure is directed to equipment used during excavation operations. More particularly, the disclosure is directed to a trench box that is installed in the ground during an excavation in order to hold back soil and protect workers in the trench from soil collapse. Specifically, the disclosure relates to a trench box that includes panels which may be selectively removed to work in specific regions of the sides of the trench.

BACKGROUND

In order to construct buildings and install utilities it is typically necessary to excavate earth at a job site. The excavation may be accomplished by using a wide range of digging tools from backhoes to shovels which remove rocks and soil from particular areas and deposit them elsewhere. In order to lay utilities or repair utilities it may be necessary to dig a trench, i.e., a hole that is usually deeper than it is wide. Workers entering the trench to lay or repair the utilities are at risk of the sides of the trench suddenly collapsing in on them and burying them.

In order to mitigate this risk it is common for a trench box to be installed in the trench as it is excavated. A trench box essentially comprises two large metal plates separated from one another by spreader bars. The ends of the trench box are open and are not covered by metal plates. Trench boxes are large and heavy and therefore have to be assembled, manipulated, installed, and removed by mechanized lifting equipment. An initial hole is dug by the digging equipment and then the trench box is installed in such a way that the metal plates are located adjacent the sides of the hole and the spreader bars hold the metal plates a set distance apart from one another. The scoop of the digging equipment is inserted between the two plates is used to continue to remove rocks and soil. The trench box is periodically tamped down using the digging equipment and digging is continued until the desired depth of the trench is reached. In some instances additional trench boxes are installed one or both of on top of the first trench box or extend outwardly beyond one end of the first trench box. Once the desired depth and length of trench is dug, soil is backfilled between the sides of the trench and the exterior surfaces of the two metal plates. The workers can then enter the trench to perform the required work.

One of the issues that is encountered while laying or repairing utilities is that in some instances pipes or conduits are arranged at angles relative to one another. Consequently, when the trench is dug and the trench box is installed the metal plates may prevent workers from accessing pipes or conduits which are oriented at an angle to the sides of the trench. In these instances the trench box has to be lifted out of the trench or moved along the length of the trench and out of the way in order for the workers to access the angled pipes or conduits. This is a time consuming and labor intensive operation and may leave workers exposed to possible soil collapse while working on the angled pipes or conduits.

SUMMARY

The trench box disclosed herein is designed for use in instances where access to areas of the sides of a trench is required. The disclosed trench box permits access to these areas without the trench box having to be lifted out of the trench or be moved further along the length of the trench.

A trench box and a method of use thereof are disclosed herein. The trench box includes a first plate to support a first side of a trench, a second plate to support a second side of a trench, and spreader bars extending between the first and second plates. One or both of the first and second plates is assembled from a plurality of modular panels arranged in a same plane and detachably secured to one another by a plurality of connectors and fasteners. A panel may be removed from one of the first plate and/or the second plate when an obstacle is encountered in the ground that runs across the trench. The removal of the panel creates an opening in the trench box to accommodate the obstacle without compromising the structural integrity of the trench box. Removal of the panel also does not negatively impact the trench box's ability to prevent collapse of the sides of the trench into the trench.

In one aspect, an exemplary embodiment of the present disclosure may provide a trench box for installation in a trench, said trench box comprising a first plate; a second plate; and a plurality of spreader bars extending between an interior surface of the first plate and an interior surface of the second plate; wherein at least one of the first plate and the second plate is comprised of a plurality of modular panels that are detachably engaged with one another.

In one embodiment, the trench box may further comprise a first connector configured to detachably secure four modular panels of the plurality of modular panels to one another. In one embodiment, the trench box may further comprise a second connector configured to detachably secure two modular panels of the plurality of modular panels to one another. In one embodiment, the plurality of modular panels in the at least one of the first plate and the second plate may be arranged in a same plane. In one embodiment at least some of the plurality of modular panels may be arranged in side-by-side abutting contact to form a row of panels. In one embodiment at least some of the plurality of modular panels may be arranged in end-to-end abutting contact to form a column of panels. In one embodiment, one of the plurality of modular panels may be detachable from the row of panels to create an opening in the row of panels or one of the plurality of the modular panels may be detachable from the column of panels to create an opening in the column of panels. The remaining panels in the row or column including the opening remain engaged with one another. In one embodiment, the at least one of the first plate and the second plate having the opening in the row of panels or the column of panels remains sufficiently strong enough to resist collapse of an adjacent side wall of the trench.

In another aspect, an exemplary embodiment of the present disclosure may provide a modular panel assembly for use in assembling a side wall of a trench box; said modular panel assembly comprising a modular panel comprising a base plate having an interior surface and an exterior surface, wherein the exterior surface is adapted to be disposed adjacent a side wall of a trench and the interior surface is adapted to be disposed remote from the side wall and face into the trench; and a frame operatively engaged with one of the interior surface and the exterior surface of the base plate.

In one embodiment, the modular panel assembly may further comprise a plurality of lugs extending away from the interior surface of the base plate, wherein the plurality of lugs are spaced a distance apart from one another. In one embodiment, at least one lug of the plurality of lugs may be detachably engageable with the base plate. In one embodiment, at least one lug of the plurality of lugs may be permanently secured to the base plate.

In one embodiment, the modular panel assembly may further comprise a connector, wherein at least two apertures are defined in the connector spaced a distance away from one another, and wherein a first aperture of the at least two apertures may be located on the connector so as to receive one of the plurality of the lugs of the modular panel therethrough, and a second aperture of the at least two apertures may be located on the connector so as to receive one of an additional plurality of lugs of an additional and adjacent modular panel therethrough.

In another aspect, and exemplary embodiment of the present disclosure may provide a method of forming a trench box comprising providing a plurality of modular panels; providing a plurality of connectors; connecting a first group of the plurality of modular panels to one another with a first group of the plurality of connectors to form a first plate of the trench box; connecting a second group of the plurality of modular panels to one another with a second group of the plurality of connectors to form a second plate of the trench box; extending a plurality of spreader bars between an interior surface of the first plate and an interior surface of the second plate.

In one embodiment, the method may further comprise arranging the first group of the plurality of modular panels in a same first plane prior to connecting the first group of the plurality of connectors thereto to form the first plate of the trench box. In one embodiment, the method may further comprise arranging the second group of the plurality of modular panels in a same second plane prior to connecting the second group of the plurality of connectors thereto to form the second plate of the trench box. In one embodiment, the method may further comprise extending one or more lugs away from an interior surface of each modular panel of the plurality of modular panels; and engaging one of the plurality of connectors with a first lug of a first modular panel and with a first lug of a second modular panel, wherein the first modular panel and the second modular panel are adjacent one another in a side-by-side configuration or an end-to-end configuration. In one embodiment, extending one or more lugs away from the interior surface of each modular panel may comprise permanently securing the one or more lugs to the interior surface of an associated modular panel.

In another aspect, and exemplary embodiment of the present disclosure may provide a method utilizing a trench box to prevent sides of a trench from collapsing into the trench, wherein the method comprises assembling a first plate from a plurality of modular panels and a plurality of connectors; assembling a second plate from the plurality of modular panels and the plurality of connectors; fixing a plurality of spreader bars between an interior surface of the first plate and an interior surface of the second plate to form a trench box; digging a trench in a ground to perform a work operation therein, wherein the trench extends in a first direction in the ground; determining an obstacle extends across the trench in a second direction, wherein the second direction is oriented at an angle to the first direction; removing one of the plurality of modular panels from one of the first plate and the second plate; and forming an opening in the one of the first plate and the second plate where the removed one of the plurality of modular panels was previously located to accommodate the obstacle.

In one embodiment, the method may further comprise the lowering of the trench box into the trench until the first plate is adjacent a first side of the trench and the second plate is adjacent a second side of the trench; and receiving the obstacle in the opening defined in the one of the first plate and the second plate. In one embodiment, the method may further comprise supporting the first side and the second side of the trench with the trench box; and preventing collapse of the first side of the trench with the first plate and preventing collapse of the second side of the trench with the second plate, and the plurality of spreader bars.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
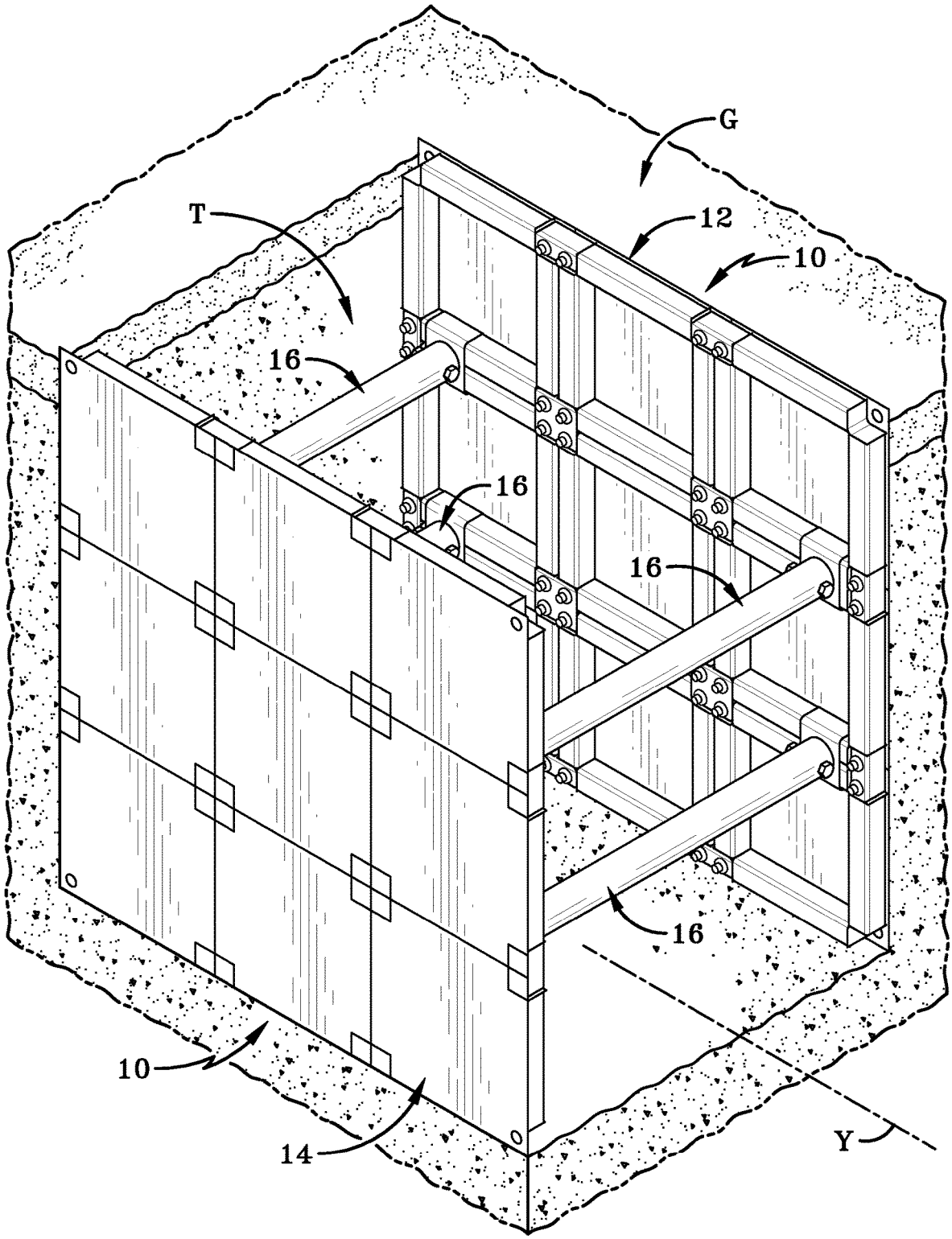
FIG. 1 is a top, front, left side isometric perspective view of a trench box in accordance with the present disclosure partially installed within a trench, with some of the ground around the trench box removed for clarity of illustration.

Referring to FIG. 1, there is shown a trench box in accordance with the present disclosure, generally indicated at 10. Trench box 10 is illustrated in an installed position within a trench "T" dug into the ground "G".

Trench box 10 comprises a first plate 12, a second plate 14 which are retained a set distance apart from one another by a plurality of spreader bars 16. In accordance with an aspect of the present disclosure, each of the first plate 12 and second plate 14 comprises a plurality of individual panels 18 which are secured to one another via connector assemblies. These components will be described in greater detail hereafter. It should be noted that the number of individual panels 18 which may be included in each of the first plate 12 and second plate 14 may be varied and can be less than or greater than the number of panels 18 illustrated in the attached figures. In other words, there may be fewer than nine panels 18 in each of first plate 12 and second plate 14 or there may be nine panels as illustrated, or there may be more than nine panels in first plate 12 and second plate 14. The first plate 12 and second plate 14 are modular in nature, being constructed from a plurality of identical modules, i.e., panels 18 and their associated connector assemblies.

Figure 3:
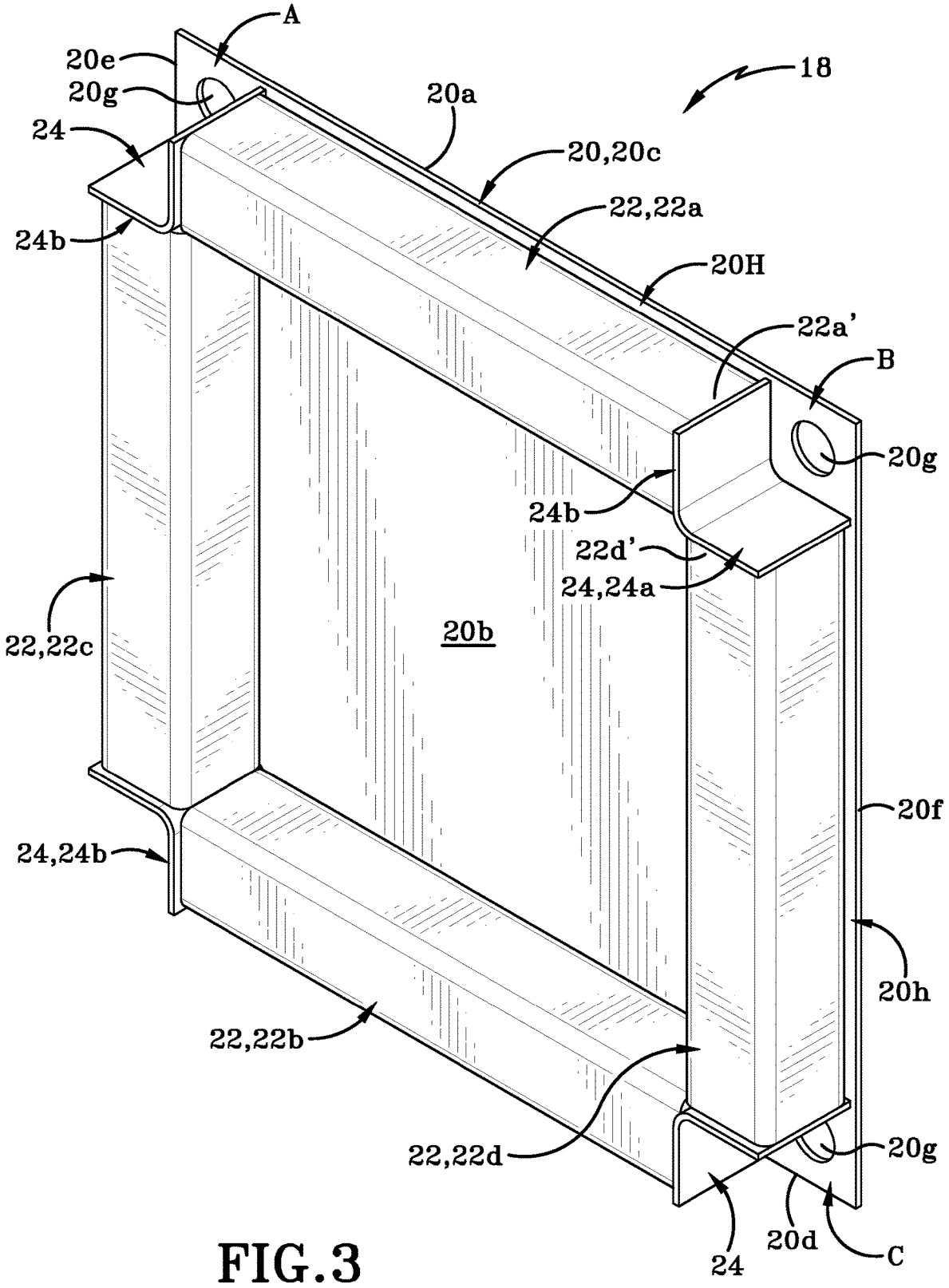
FIG. 3 is a top, front, left side isometric perspective view of a single panel or module of the trench box, wherein the panel or module is shown in isolation.

FIG. 3 shows a single panel 18 (or module 18) in isolation. Panel 18 comprises a base plate 20, a frame comprising one or more frame members 22, and one or more brackets 24. Base plate 20, frame members 22, and brackets 24 are comprised of metal. One suitable metal for fabrication of base plate 20, frame members 22, and brackets 24 is steel.

Base plate 20 has an exterior surface 20*a*, an interior surface 20*b*, a first end 20*c*, a second end 20*d*, a first side edge 20*e*, and a second side edge 20*f*. When a plurality of modular panels 18 are assembled into a first plate 12 or second plate 14 of the trench box 10, the exterior surfaces 20*a* of the base plates 20 of the panels 18 will be located adjacent the side walls of the trench "T" into which trench box 10 is placed. The interior surfaces 20*b* of the base plates 20 of the modular panels will face inwardly into the trench "T", i.e., away from the ground "G" which abuts the exterior surfaces 20*a* of those panels 18. An aperture 20*g* is defined in the base plate 20 proximate each corner thereof. Each aperture 20*g* extends between exterior surface 20*a* and interior surface 20*b* of plate 20. The purpose of apertures 20*g* will be described later herein.

Panels 18 are fabricated to be of any suitable size and weight that can be readily lifted and manipulated by a construction worker but which will provide sufficient strength, when combined with the other components that form trench box 10, to prevent collapse of the side walls of the trench "T". One suitable size for the base plate 20 of each panel 18 is a two foot by two foot square which is about 9 gauge in thickness (measured from exterior surface 20*a* of plate 20 through to interior surface 20*b* thereof). It will be understood, however, that smaller base plates or larger base plates may be utilized in the fabrication of panel 18. Furthermore, while the base plate 20 is illustrated as being square in configuration, other shapes of base plate may be used instead. For example, the base plate could be a rectangular shape instead of being square. Additionally, while a suitable thickness for base plate 20 may be about 9 gauge sheet material, the base plate thickness may be less than a $\frac{1}{8}^{th}$ inch or greater than a $\frac{1}{4}^{th}$ inch without departing from the scope of the present disclosure. The overall weight of panel 18 may be from about 25 lbs. up to about 150 lbs. but it will be understood that panel 18 may be of a lesser weight or of a greater weight without departing from the scope of the present disclosure.

As indicated earlier herein, panel 18 includes a frame that is operatively engaged with interior surface 20*b* of base plate 20. As illustrated, the frame comprises four frame members 22 with each frame member comprising a length of metal tubing that is welded or otherwise secured to interior surface 20*b* of base plate 20. The frame provides structural strength and rigidity to panel 18. It will be understood that in other embodiments, the frame members may be welded or otherwise secured to exterior surface 20*a* of each base plate 20. In still further embodiments, some of the frame members may be welded to the exterior surface 20 and other frame members may be welded to the interior surface 20*b*. Still further, in yet other embodiments, additional frame members may be provided and a set of frame members may be welded to the exterior surface 20*a* of the base plate 20 and a set of frame members may be welded to interior surface 20*b* of base plate 20.

As illustrated, each frame member 22 comprises a length of metal tubing which is square in cross-section. Four frame members 22 are illustrated as being welded or otherwise secured to interior surface 20*b* of base plate 20. In particular a first frame member 22*a* is secured to interior surface proximate first end 20*c* of base plate 20; a second frame member 22*b* is secured to interior surface 22*b* proximate second end 20*d*; a third frame member 22*c* is secured to interior surface 22*b* proximate first side edge 20*e*; and a fourth frame member 22*d* is secure to interior surface 22*b* proximate second side edge 20*f*. FIG. 3 shows that a narrow lip of base plate 20 extends outwardly beyond an outermost side of each of the frame members 22. For example a lip 20*h* of base plate 20 extends outwardly beyond first frame member 22*a* and first end 20*c*, and a lip 20*h* of base plate 20 extends outwardly beyond fourth frame member 22*d* and second side edge 20*f*. Each of the first, second, third, and fourth frame members is of a shorter length than the respective one of the first end 20*c*, second end 20*d*, first side edge 20*e*, and second side edge 20*f* proximate which the respective frame members 22*a* through 22*d* are secured. The frame members 22*a* through 22*d* are each centered relative to the length of the associated one of the first end 20*c*, second end 20*d*, first side edge 20*e*, and second side edge 20*f*, leaving a region of the base plate 20 proximate the four corners free of an frame member 22. Generally L-shaped brackets 24 extend between the ends of adjacent frame members 22 and are welded or otherwise secured thereto. For example a first L-shaped bracket 24*a* extends between one end 22*a*' of first frame member 24 and the adjacent end 22*d*' of fourth frame member 22*d*. The L-shaped brackets help to increase the structural strength and integrity of panel 18.

Figure 4:
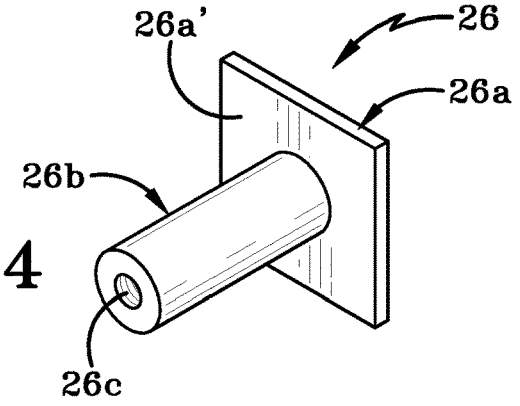
FIG. 4 is a top, front, left side isometric perspective view of a lug to be used with the panel of FIG. 3.

FIG. 4 shows a lug 26 which is configured to be inserted through one of the apertures 20*g* defined in base plate 20. Lug 26 comprises a base 26*a* and a boss 26*b* extending outwardly from a surface 26*a*' of the base 26*a*. As illustrated, boss 26*b* is cylindrical in shape and is welded to surface 26*a*' of base 26*a* in such a way that the boss 26*b* is oriented at a right angle to surface 26*a*'. Boss 26*b* defines an interiorly threaded bore 26*c* that opens at a free end of boss 26*b* remote from base 26*a*.

Lug 26 is configured to be inserted through one of the apertures 20*g* of base plate 20. In particular, lug 26 is oriented such that the surface 26*a*' of the base 26*a* of lug 26 will abut the exterior surface 20*a* of base plate 20 and the cylindrical boss 26*b* will extend through the aperture 20*g* and project for a distance beyond interior surface 20*b* of base plate 20. Cylindrical boss 20*b* extends for a short distance outwardly beyond the interior edge 24*b* of the L-shaped bracket 24 which partially bounds the associated corner region of base plate 20.

Figure 5:
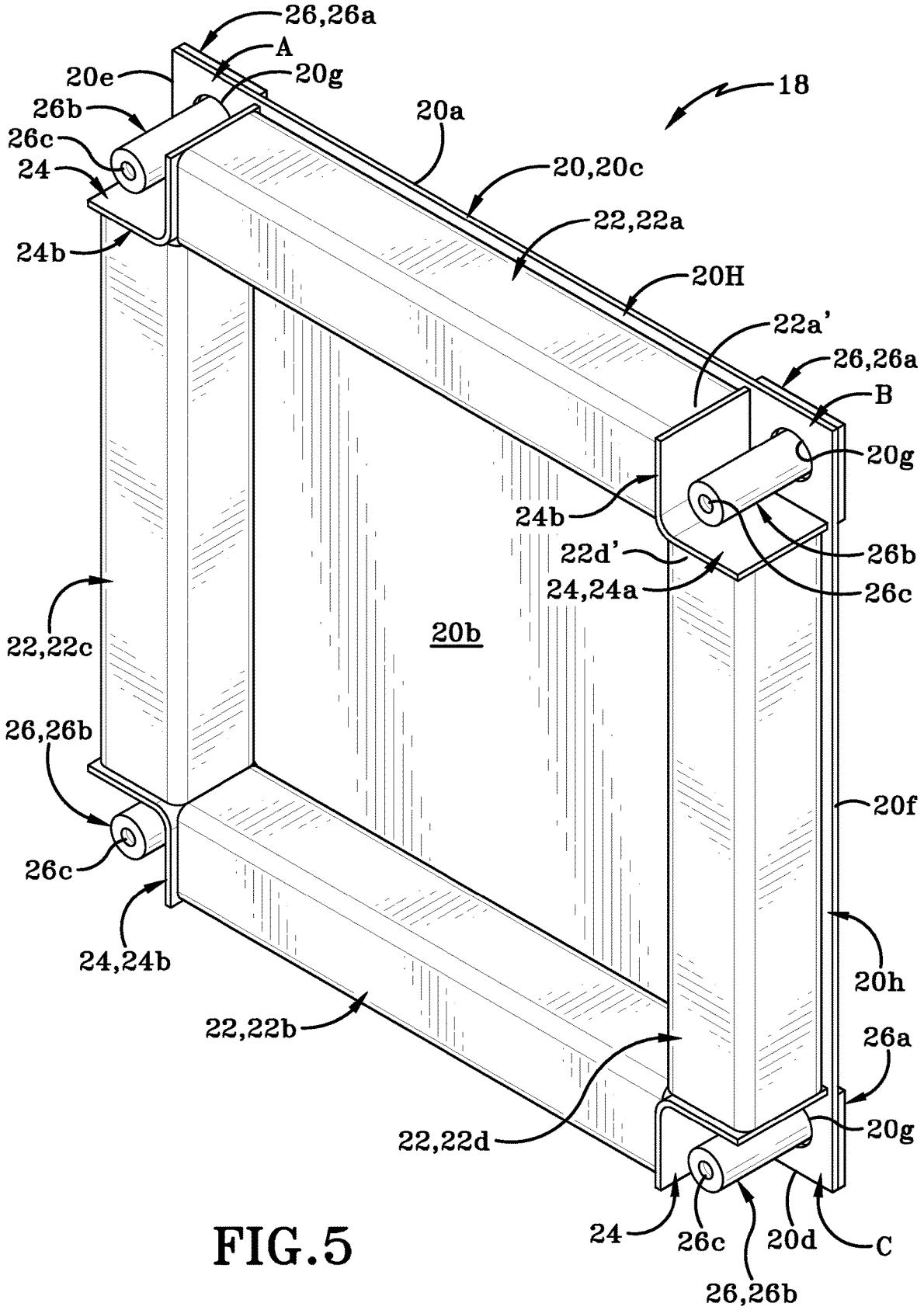
FIG. 5 is a top, front, left side isometric perspective view of an alternative single panel or module of the trench box, wherein the lugs are integral with or permanently and fixedly secured to the base plate of the panel.

In some embodiments, lug 26 is selectively insertable through aperture 20*g* and is furthermore selectively removable from aperture 20*g*. In other embodiments, such as is illustrated in FIG. 5, the base 26*a* of lug 26 is welded to exterior surface 20*a* of base plate 20 in such a way that lug 26 extends for a distance beyond interior surface 20*b* of base plate 20. In particular, the cylindrical boss 26*b* extends for a short distance outwardly beyond the interior edge 24*b* of the L-shaped bracket 24 which partially bounds the respective corner region of the base plate 20.

Figure 2:
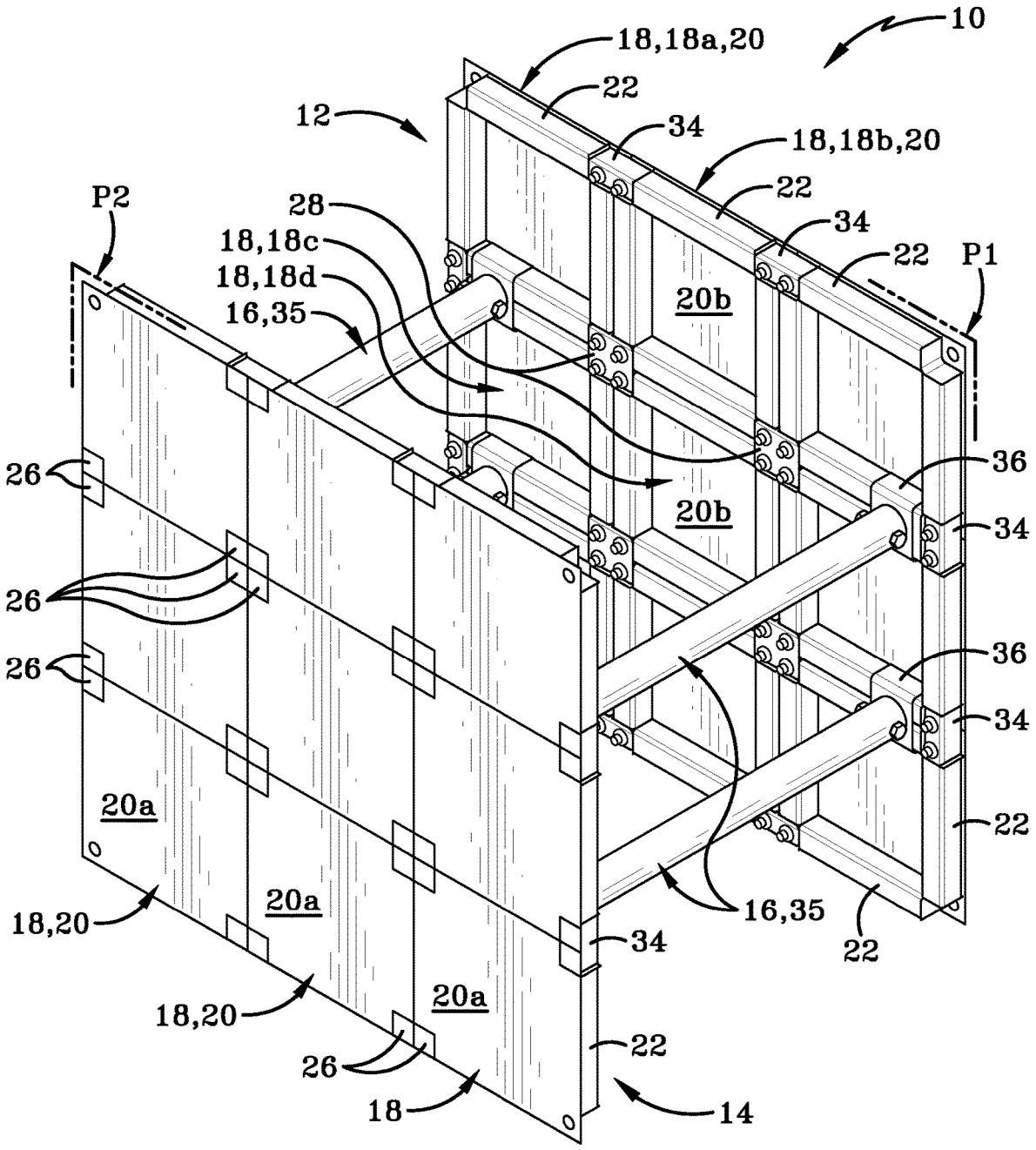
FIG. 2 is a top, front, left side isometric perspective view of the trench box in accordance with the present disclosure, shown in isolation.
Figure 6:
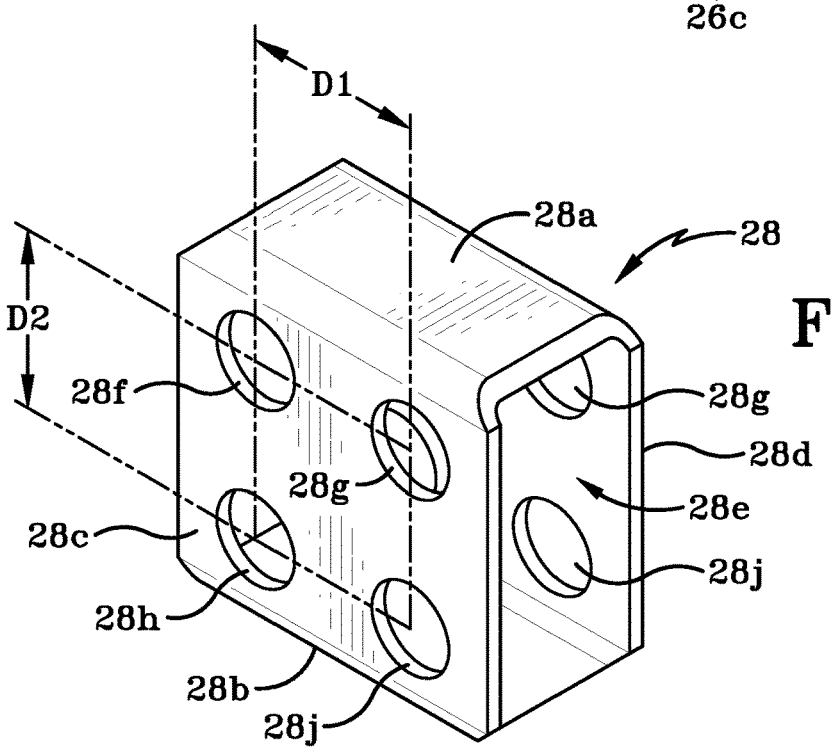
FIG. 6 is a top, front, left side isometric perspective view of a first connector for securing four panels of the trench box to one another.
Figure 7:
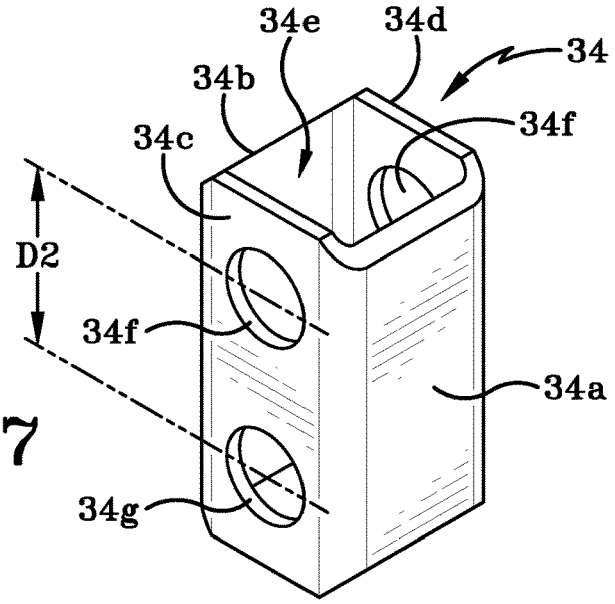
FIG. 7 is a top, front, left side isometric perspective view of a second connector for securing two panels of the trench box to one another.

Referring now to FIGS. 6 and 7, two differently configured connectors may be utilized to secure the modular panels 18 to one another in order for assemble first plate 12 or second plate 14 of trench box 10 to one another. Modular panels 18 are arranged in a same plane "P1" (FIG. 2) in order to ultimately be assembled together to form first plate 12 or in a same plane "P2" to form second plate 14. Obviously, the modular panels 18 used in first plate 12 will be in a different plane to the modular panels used to form second plate 14. At least some of the modular panels 18 to form first plate 12, for example, are arranged in side-by-side abutting contact to form a row of panels 18. Others of the modular panels 18 are arranged in end-to-end abutting contact to form a column of panels 18. FIG. 6 shows a first connector 28 which is used to secure four adjacent individual panels 18 to one another, where those panels 18 will ultimately form part of an interior region of the first plate 12 or second plate 14.

In order to secure the four panels 18 to one another, the panels 18 are laid out in a square configuration. First panel 18*a* (FIG. 2) and second panel 18*b* are arranged in a first row and third panel 18*c* and fourth panel 18*d* are arranged in a second row. The first and second panels 18*a* and 18*b* are arranged side-by-side, such that the second side edge 20*f* (FIG. 3) of first panel 18*a* abuts the first side edge 20*e* of second panel 18*b*. Similarly, third and fourth panels 18*c* and 18*d* are arranged side-by-side such that the second side edge 20*f* of third panel 18*c* abuts the first side edge 20*e* of fourth panel 18*d*. The first row is placed adjacent the second row such that the second ends 20*d* of the first and second panels 18*a*, 18*b* abut the first ends 20*c* of the third and fourth panels 18*c*, 18*d*, respectively. In other words, first panel 18*a* is located in end-to-end abutting contact with third panel 18*c* to form a first column. Second panel 18*b* is located in end-to-end abutting contact with fourth panel 18*d* to form a second column. When arranged in this square configuration, the first side edges 20*e* of the first and third panels 18*a*, 18*c* are aligned with one another and the second side edges 20*f* of the second and fourth panels 18*b*, 18*d* are aligned with one another.

Figure 9:
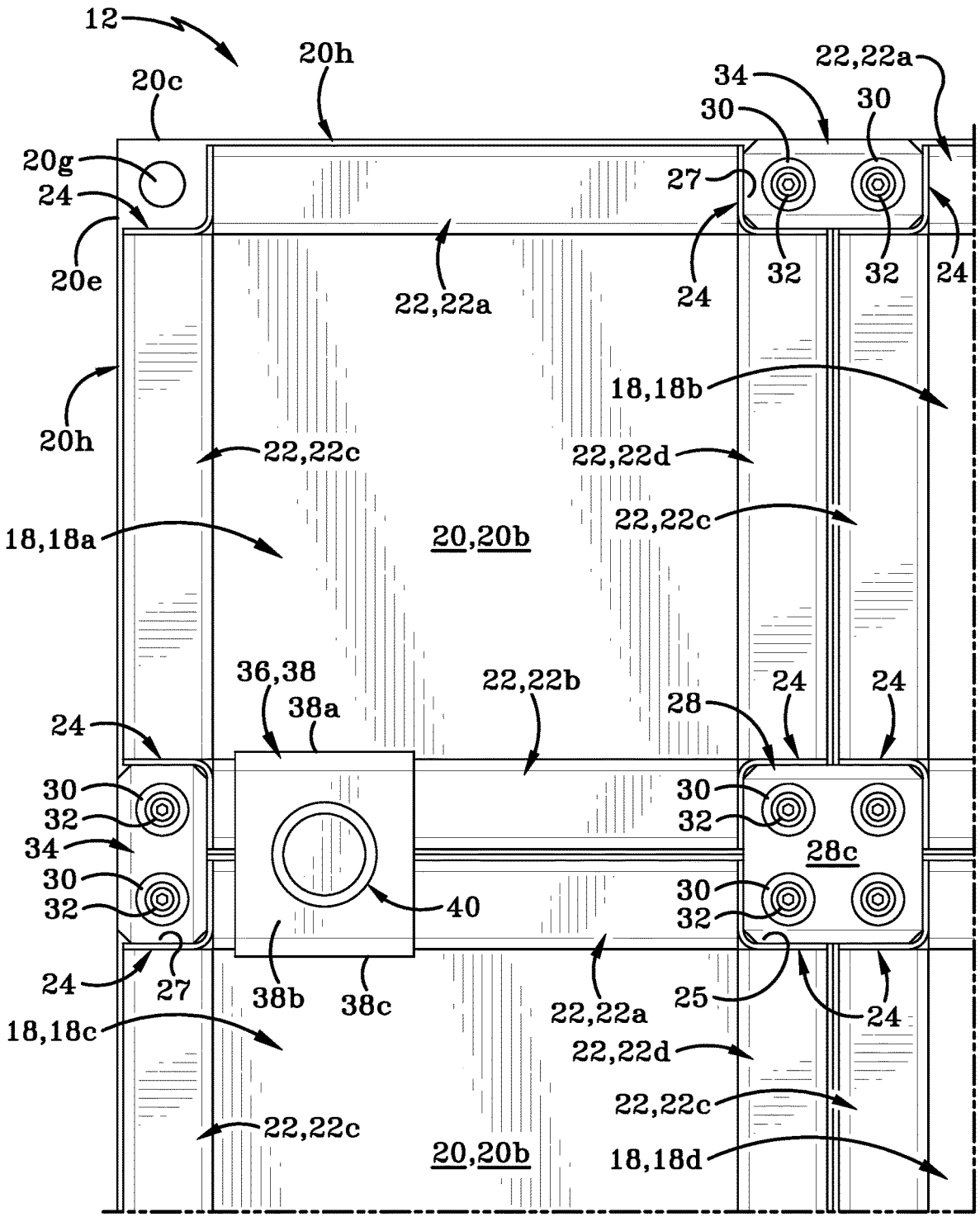
FIG. 9 is an enlarged fragmentary elevation view of a top left corner region of the first plate of the trench box shown in FIG. 8.
Figure 10A:
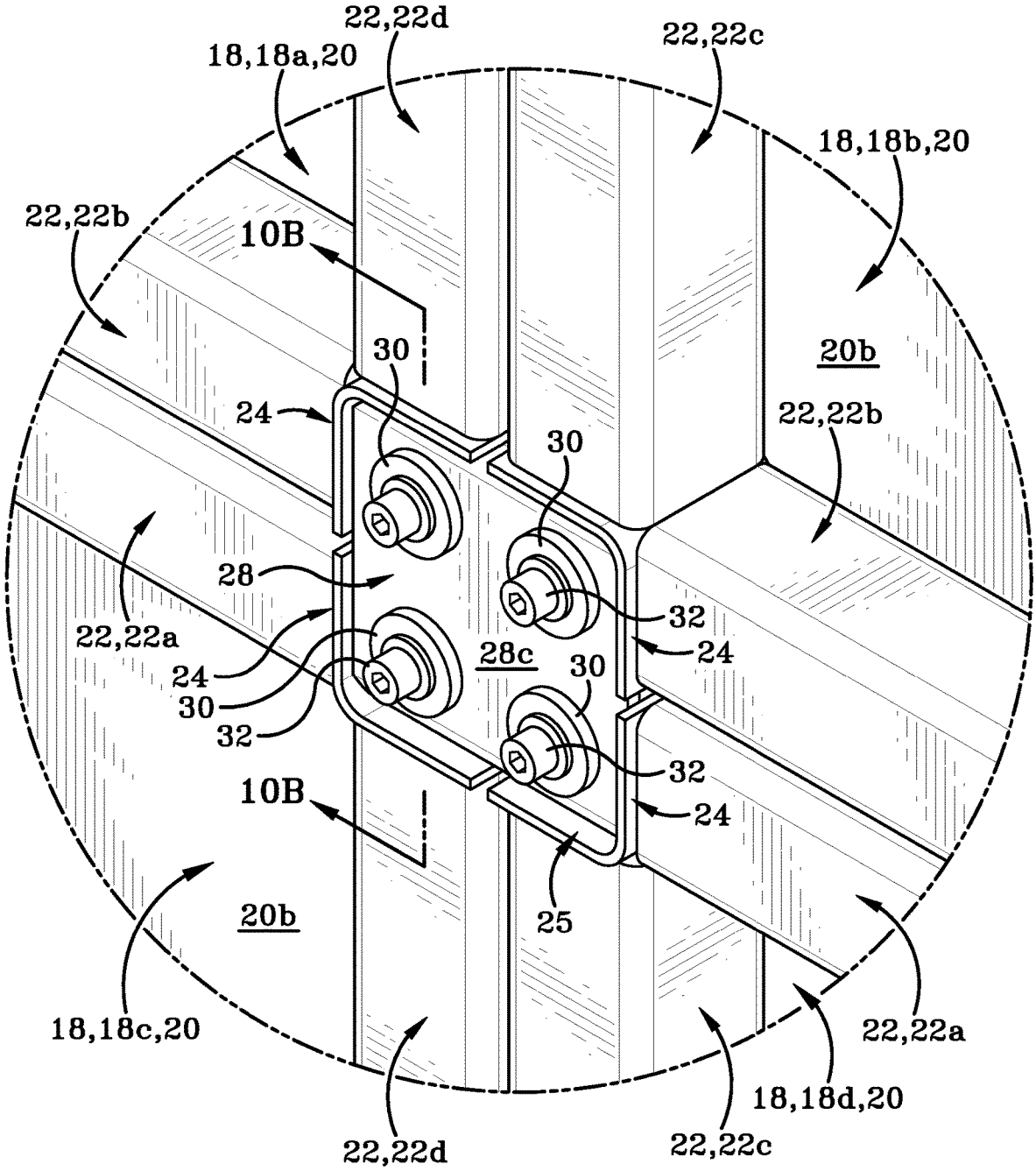
FIG. 10A is an enlargement of a first highlighted region of FIG. 8 showing a first connector being used to secure four panels to one another.
Figure 10B:
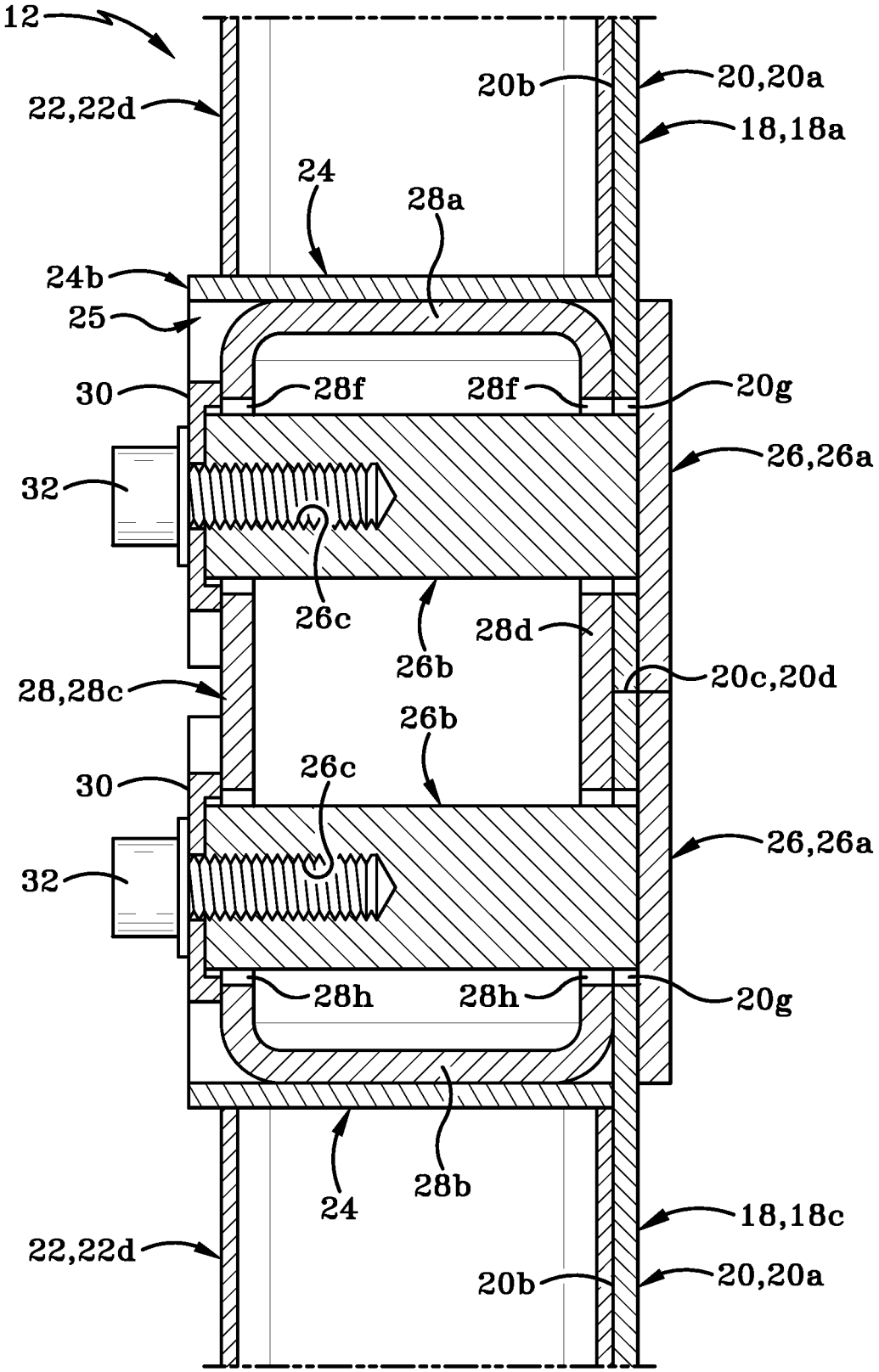
FIG. 10B is a cross-section of the first connector and associated panels taken along line 10B-10B of FIG. 10A.

The arrangement of the four panels 18*a*, 18*b*, 18*c*, and 18*d* also causes the corner regions at the center of the square shape to abut one another. In other words, if looking at the orientation of the panel 18 shown in FIG. 3, the top left corner region is numbered "A", the top right corner region is numbered "B", the bottom right corner region is numbered "C", and the fourth corner region, though not visible in this figure, will be numbered "D". In the arrangement of the four panels 18*a*, 18*b*, 18*c*, 18*d*, the corner regions at the center of the square shape will comprise corner "C" of panel 18*a*, corner "A" of panel 18*b*, the corner "B" of panel 18*c*, and the corner "D" of panel 18*d*. A lug 26 is extended through each of the four apertures 20*g* in this center of the square of four panels 18*a* through 18*d*. The L-shaped brackets 24 on the four panels 18*a*, 18*b*, 18*c*, 18*d*, together, circumscribe the four abutting corner regions "C", "A", "B" and "D" of the panels and form a receptacle 25 (FIGS. 9 and 10A). A lug 26 from each of the panels 18*a*, 18*b*, 18*c*, and 18*d* extends into the receptacle 25 bounded and defined by the four brackets 24. The first connector 28 is configured to be received into receptacle 25 in order to be engaged with the four lugs 26.

First connector 28 comprises a section of tubing that is a rectangular cuboid in shape and is rectangular in cross-section. First connector 28 has a first end wall 28*a*, an opposed second end wall 28*b*, a first side wall 28*c*, and an opposed second side wall 28*d*. First and second end walls 28*a*, 28*b* and first and second side walls 28*c*, 28*d* bound and define a bore 28*e* which extends through first connector 28.

A first row of apertures 28*f*, 28*g* is defined in each of the first side wall 28*c* and second side wall 28*d*. The apertures 28*f*, 28*g* are in fluid communication with bore 28*e*. The apertures 28*f* are laterally aligned with one another and the apertures 28*g* are laterally aligned with one another. Apertures 28*f*, 28*g* are also spaced a longitudinal distance apart from one another. It should be noted that the longitudinal distance "D1" between the center of aperture 28*f* and the center of aperture 28*g* is substantially equal to the longitudinal distance between the centers of the lugs 26 extending from the corner region "C" of first panel 18*a* and the corner region "D" of the second panel 18*b*.

A second row of apertures 28*h*, 28*j* is defined in each of the first side wall 28*c* and second side wall 28*d*. The apertures 28*h*, 28*j* are in fluid communication with bore 28*e*. The apertures 28*h* are laterally aligned with one another and the apertures 28*j* are laterally aligned with one another. Apertures 28*h*, 28*j* are also spaced a longitudinal distance apart from one another. It should be noted that the longitudinal distance "D1" between the center of aperture 28*h* and the center of aperture 28*j* is substantially equal to the longitudinal distance between the centers of the lugs 26 extending from the corner region "B" of the third panel 18*c* and the corner region "A" of the fourth panel 18*d*.

Furthermore, as shown in FIG. 6, the center of aperture 28*f* and the center of aperture 28*h* are spaced a distance "D2" from one another. Similarly, the centers of apertures 28*g* and 28*j* are spaced the same distance "D2" from one another. The distance "D2" is substantially equal to the distance between the center of the lug 26 extending from the corner region "C" of first panel 18*a* and the corner region "B" of the third panel 18*c*. It should further be noted that the distances "D1" and "D2" are substantially equal to one another.

In order to assemble first, second, third, and fourth panels, 18*a*, 18*b*, 18*c*, and 18*d*, the panels may be laid on a flat surface such that the exterior surfaces 20*a* contact the flat surface. This places all four panels 18*a* through 18*d* in a same plane. It will be understood that in other instances the panels 18*a* through 18*d* may be connected to one another when vertically oriented instead of horizontally oriented. The following description will presume the panels 18*a* through 18*d* are laid on a flat, horizontally-oriented surface.

The panels are moved toward one another until the base plates 20 thereof abut one another in the configuration described earlier herein and as is shown in FIG. 9. First connector 28 is then placed over the four lugs 26 extending outwardly from the center of the square shape formed by the four panels. In particular, the lug 26 of first panel 18*a* may be received through the aligned apertures 28*f*, the lug 26 of second panel 18*b* may be received through aligned apertures 28*g*, the lug 26 of third panel 18*c* may be received through aligned apertures 28*h*, and the lug 26 of fourth panel 18*d* may be received through aligned apertures 28*h*. Obviously, first connector 28 may be brought into contact with the lugs 26 on the four panels in a different orientation such as rotated through 180 degrees. In that instance the lug 26 of first panel 18*a* may be received through the aligned apertures 28*g* instead.

Once the lugs 26 at the center of the square formation of panels 18*a* through 18*d* are received through the apertures of the first connector 28, a washer 30 is received about boss 26*b* of each lug 26 and a fastener 32 is used to secure lug 26 to first connector 28. The fastener may take the form of a nut that or may be a type that is externally threaded and is engaged with internally threaded bore 28*c* of each lug 26. Fasteners 32 are tightened to a sufficient degree that the center region of the four panels 18*a* to 18*d* is secured together and will move as a unitary component.

FIG. 7 shows a second connector 34 which is used to secure two adjacent individual panels 18 to one another. In particular, second connector 34 is used to secure two adjacent panels 18 to one another that will ultimately form part of a perimeter of the first plate 12 or second plate 14. Second connector 34 is configured to be engaged with two lugs 26 provided on the two adjacent panels 18. Second connector 34 comprises a section of tubing which is generally a rectangular cuboid in shape and has a square cross-section. Second connector 34 has a first end wall 34*a*, an opposed second end wall 34*b*, a first side wall 34*c*, and an opposed second side wall 34*d*. First and second end walls 34*a*, 34*b* and first and second side walls 34*c*, 34*d* bound and define a bore 34*e* which extends through second connector 34.

A first aperture 34*f* and a second aperture 34*g* are defined in each of the first side wall 34*c* and second side wall 34*d*, and are in fluid communication with bore 34*e*. Apertures 34*f* are laterally aligned with one another and apertures 34*g* are laterally aligned with one another. Apertures 34*f*, 34*g* are also spaced a longitudinal distance apart from one another. It should be noted that the distance "D2" between a center of aperture 34*f* and a center of aperture 34*g* on first side wall 34*c* is substantially equal to the distance between the centers of the lugs 26 extending from the two adjacent panels 18 with which the second connector 34 will be engaged.

Figure 11A:
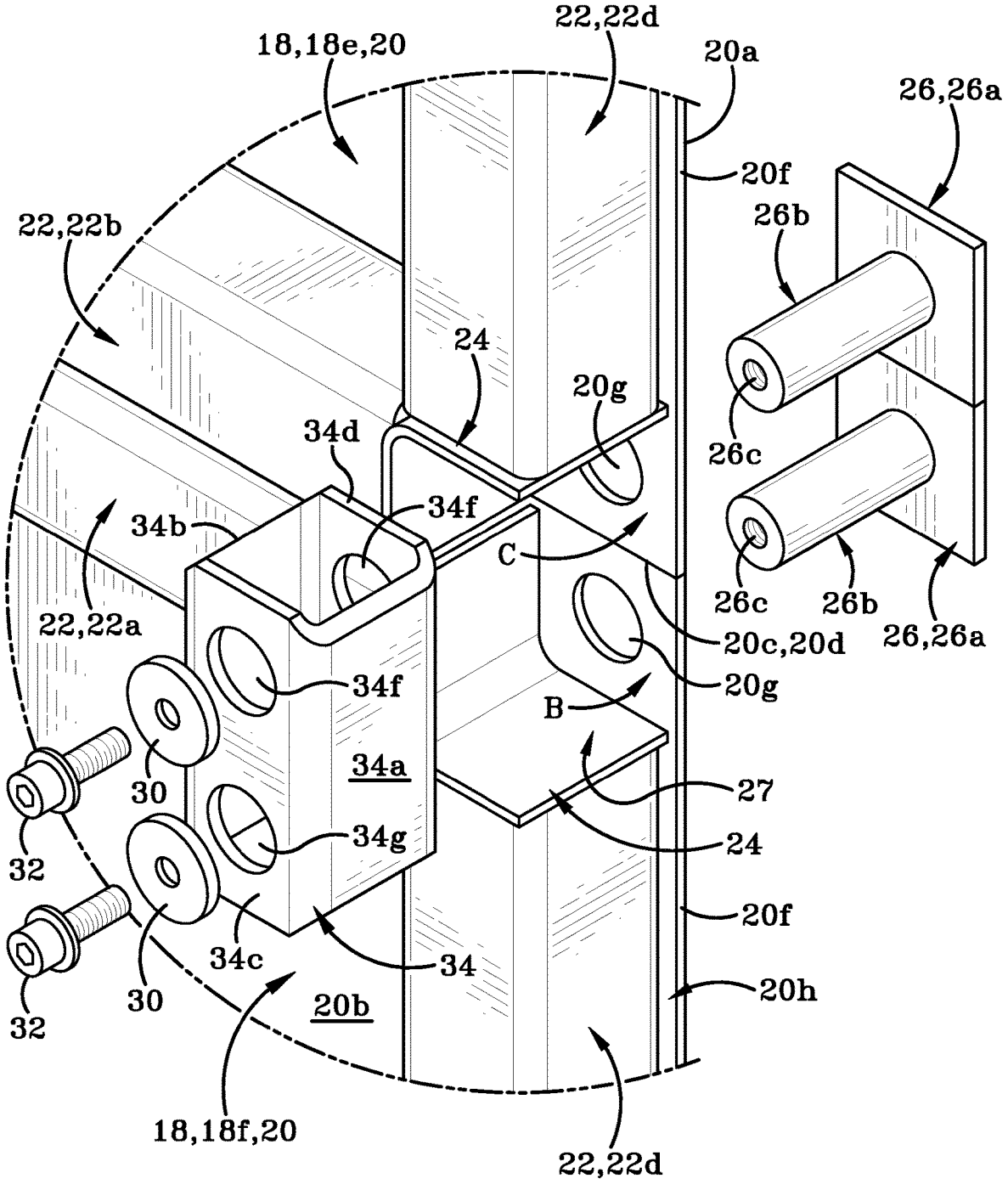
FIG. 11A is a partially exploded top, front, left side isometric perspective view of a second connector positioned to secure two panels to one another.
Figure 11B:
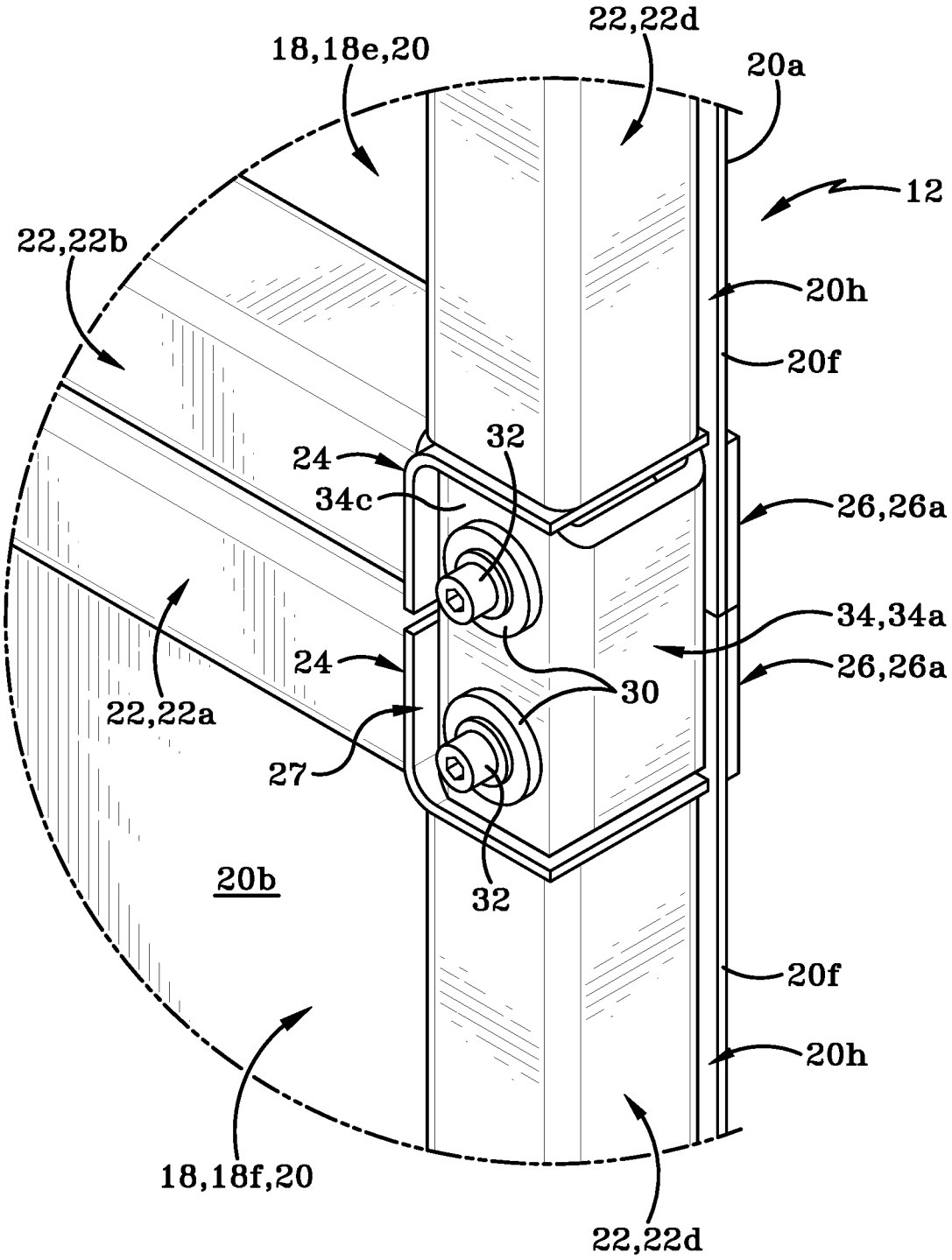
FIG. 11B is an enlargement of a second highlighted region of FIG. 8 showing the second connector being used to secure two panels to one another.

Referring to FIGS. 9, 11A, and 11B, second fastener 34 may be utilized to secure two panels 18*e*, 18*f* to one another to form a region of the perimeter of first plate 12 of trench box 10. Panels 18*e* and 18*f* may be laid on a flat surface such that the exterior surfaces 20*a* (FIG. 2) of the base plates 20 thereof contact the flat surface. This places panels 18*e* and 18*f* in a same plane. It will be understood that in other instances the panels 18*e* and 18*f* may be connected to one another when vertically oriented instead of horizontally oriented.

Panels 18*e* and 18*f* are moved toward one another until the base plates 20 thereof abut one another. In particular, the second end 20*d* of panel 18*e* abuts the first end 20*c* of panel 18*f*, the first side edges 20*e* of panels 18*e* and 18*f* are aligned with one another, and the second side edges 20*f* of panels 18*e* and 18*f* are aligned with one another. In this configuration corner region "C" (FIG. 3) of panel 18*e* is located adjacent corner region "B" of panel 18*f*. The L-shaped brackets 24 on the two adjacent panels 18*e*, 18*f* together, at least partially bound and define a receptacle 27 (FIGS. 9 and 11A). A lug 26 from each of the panels 18*e*, 18*f* extends into the receptacle 27 and second connector 34 is configured to be received into receptacle 27 in order to be engaged with the two lugs 26.

FIG. 11A illustrates a version of the panels where the boss 26*b* of each lug 26 is inserted through the aperture 20*g* of the associated panel corner region. It will be understood that in other versions of the panel, such as that shown in FIG. 5, the lugs 26 are welded or otherwise fixedly secured to base plate 20.

Second connector 34 is placed over the two lugs 26 as illustrated in FIG. 11A such that the lug 26 of panel 18*e* is received through the aligned apertures 34*f* of second connector 34 and the lug 26 of panel 18*f* is received through the aligned apertures 34*g* of second connector 34. A washer 30 and fastener 32 is then used to lock second connector 34 to panels 18*e* and 18*f*, and thereby lock panels 18*e* and 18*f* to one another so that they will move as a unitary component.

Figure 8:
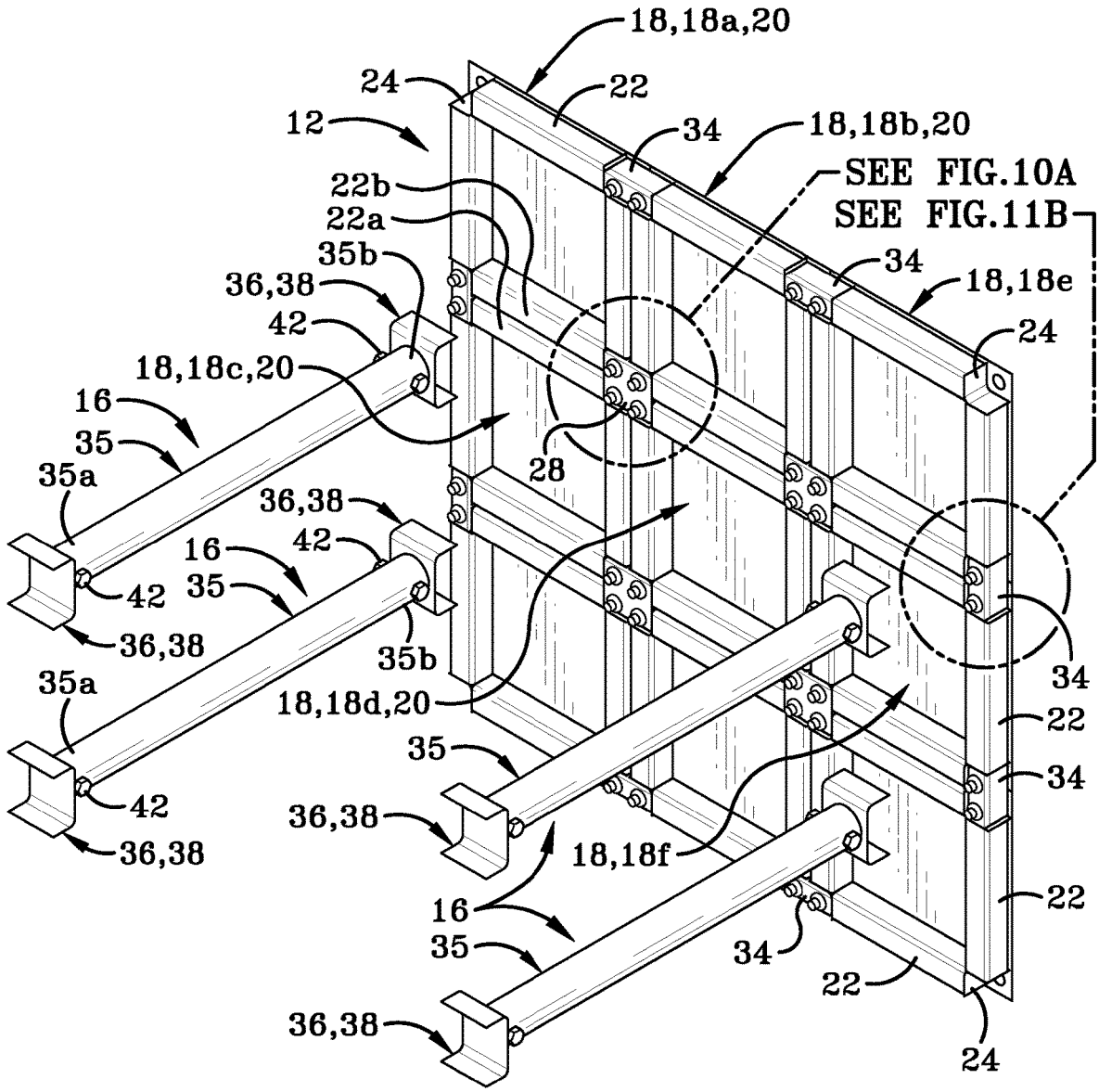
FIG. 8 is a partially exploded top, front left side isometric perspective view of the trench box of FIG. 2 with the second plate removed for clarity of illustration.

FIG. 8 shows that the plurality of panels 18 selected to form first plate 12 of trench box are secured to one another via a plurality of first connectors 28 and a plurality of second connectors 34. Wherever the corners of four panels abut one another then a first connector 28 is utilized to secure the lugs 26 in those four corners to one another, and thereby secure the four abutting panels 18 to one another. Wherever the corners of two panels abut one another (around the perimeter of the first plate 12 that is being assembled), then a second connector is utilized to secure the lugs in those two corners to one another and thereby secure the two abutting panels 18 to one another.

Referring to FIG. 8, once first plate 12 (and second plate 14) are formed from the desired number of panels 18 which are secured together with the appropriate first connectors 28, second connectors 34 and fasteners 32, a plurality of spreader bars 16 are connected to first plate 12 and second plate 14 to maintain the two plates a desired distance apart from one another. FIG. 8 shows spreader bars 16 of a fixed length being positioned for engagement with first plate 12. However, it will be understood that adjustable length spreader bars (not shown but well known in the art) may be used instead of the fixed length spreader bars 16.

Figure 12:
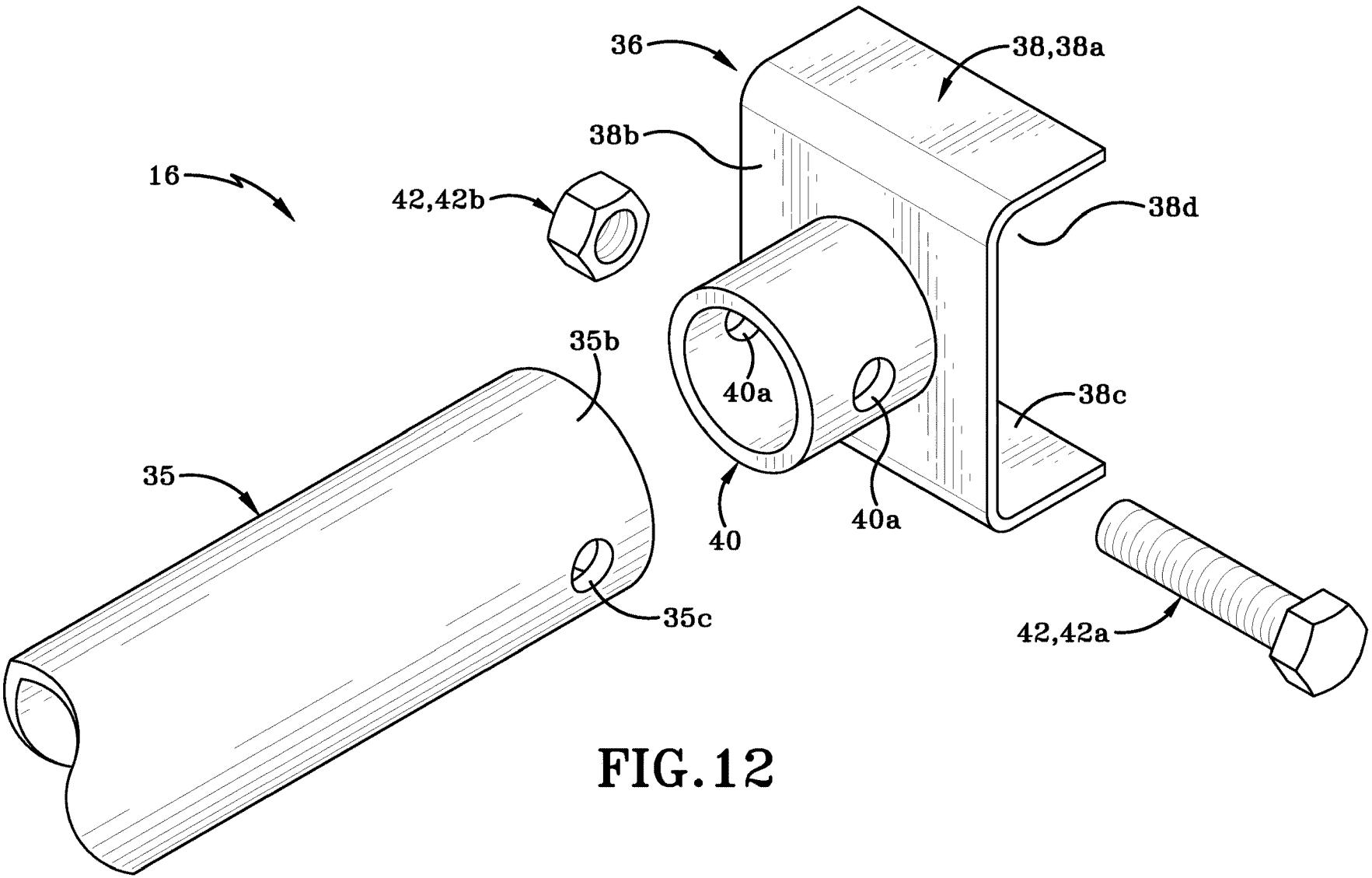
FIG. 12 is an exploded, fragmentary perspective view of one end of a spreader bar and a mounting bracket used to secure the spreader bar to a first plate or second plate of the trench box.

Each spreader bar 16 comprises a tube 35 and a pair of brackets 36. Tube 35 has a first end 35*a* and a remote second end 35*b*. A mounting bracket 36 is secured to each of the first end 35*a* and second end 35*b* of tube 35. Each mounting bracket 36 is then secured to a respective one of the first plate 12 and second plate 14. Referring to FIG. 12 a portion of tube 35 and the mounting bracket 36 to be engaged therewith is illustrated. Tube 35 has a pair of aligned holes 35*c* (FIG. 12) defined in each of the first end 35*a* (FIG. 8) and second end 35*b* thereof. Only one of the two holes 35*c* is shown in FIG. 12 but it will be understood that a second hole is located diametrically opposite the hole 35*c* which is visible in this figure. Mounting bracket 36 comprises a C-shaped plate 38 having a first leg 38*a*, a second leg 38*b*, and a third leg 38*c*. First, second, and third legs 38*a*, 38*b*, 38*c* bound and define a gap 38*d* therebetween. Gap 38*d* is sized to receive the abutting frame members 22 of two adjacent panels 18 therein. For example, as shown in FIGS. 8 and 9, mounting bracket 36 of a first of the four spreader bars 16 has a C-shaped plate 38 defining gap 38*d* sized to receive the second frame member 22*b* of first panel 18*a* and the first frame member 22*a* of third panel 18*c* therein.

Mounting bracket 36 further comprises a tubular boss 40 which is welded to second leg 38*b* of C-shaped plate 38 and extends outwardly away therefrom in an opposite direction to first leg 38*a* and third leg 38*c*. Boss 40 has an exterior diameter that is complementary to an interior diameter of a bore of tube 35. A pair of apertures 40*a* are defined through the exterior wall of boss 4 in such a way that the apertures are able to be aligned with the holes 35*c* defined in the exterior wall of tube 35 when boss 40 is received into the bore of the tube 35. A suitable locking mechanism 42 is utilized to secure spread bar 16 and mounting bracket 36 to one another. FIG. 12 illustrates locking mechanism 42 in the form of an exteriorly-threaded bolt 42*a* and an internally-threaded nut 42*b*. When boss 40 is received within the bore of tube 35 and the holes and apertures 35*c*, 40*a* are aligned with one another, bolt 42*a* is inserted through the aligned holes 35*c*, 40*a*, and nut 42*b* is used to lock bolt 42*a* in place. In other suitable locking mechanism may be used to spreader bars 16 to the associated mounting brackets 36.

Mounting bracket 36 is secured to the panels 18 of first plate 12 (or second plate 14) in any suitable manner. For example, mounting bracket 36 may be tack-welded, spot-welded or finally welded to the frame members 22 with which the C-shaped plate 38 is engaged. In other instances, fasteners or clamps may be utilized to secure mounting brackets 36 to panels 18 and thereby secure spreader bars 16 to first plate 12 (or second plate 14).

Once first plate 12 and second plate 14 have been assembled from the desired number of panels 18 as described herein and once the spreader bars 16 have been engaged with first plate 12 and second plate 14, the assembled trench box 10 may be installed in the ground in the manner well known in the art. Trench box 10 may be utilized in the same manner as other known trench boxes and may subsequently be removed from the ground in substantially the same manner as is well known in the art.

Trench box 10, however, can be used in a completely unique and novel manner relative to other known trench boxes. This unique and novel manner of use is available where worker need to perform work in the trench "T" (FIG. 1) but encounter a situation where a pipe or other obstruction intersects the trench "T" at an angle, such as at 90 degrees relative to the main trench. In these instances, one or more selected panels 18 may be removed from one or both of first plate 12 and second plate 14 as is needed. The particular panel(s) 18 to be removed from the first plate 12 (and/or second plate 14) depends upon what obstacle is intersecting the main trench "T" at an angle. It should be noted that the number of panels 18 that are able to be removed from first plate 12 or second plate 14 depends on the rest of the plate 12, 14 remaining sufficiently strong enough and rigid enough to prevent the side walls of the trench from being able to collapse inwardly into the trench. The number of panel(s) 18 that may be removed also depends on the overall dimensions of the first plate 12 and second plate 14.

Figure 13:
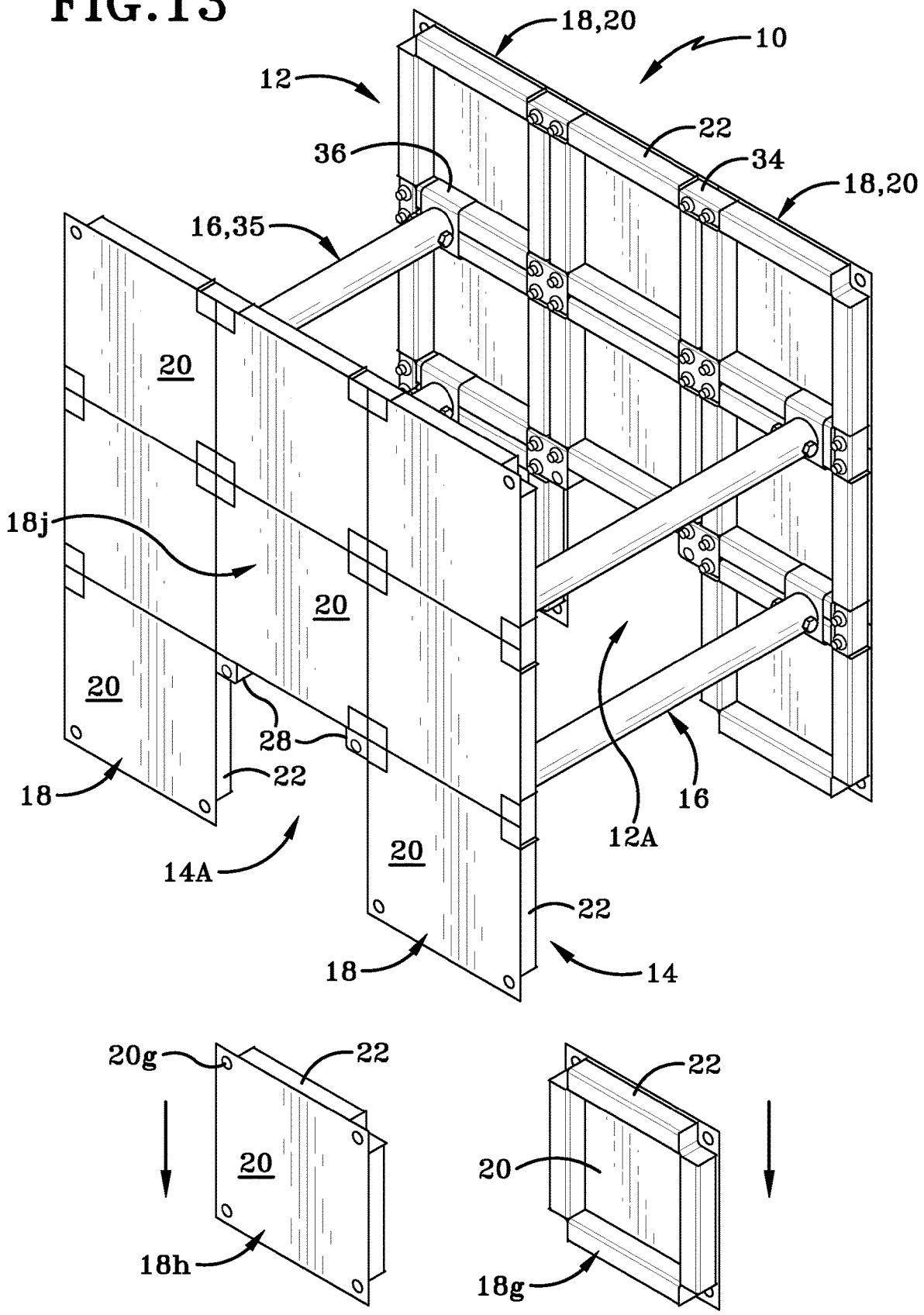
FIG. 13 is a top, front, left side isometric perspective view of the trench box of FIG. 2 with a panel removed from each of the first plate and second plate.
Figure 14:
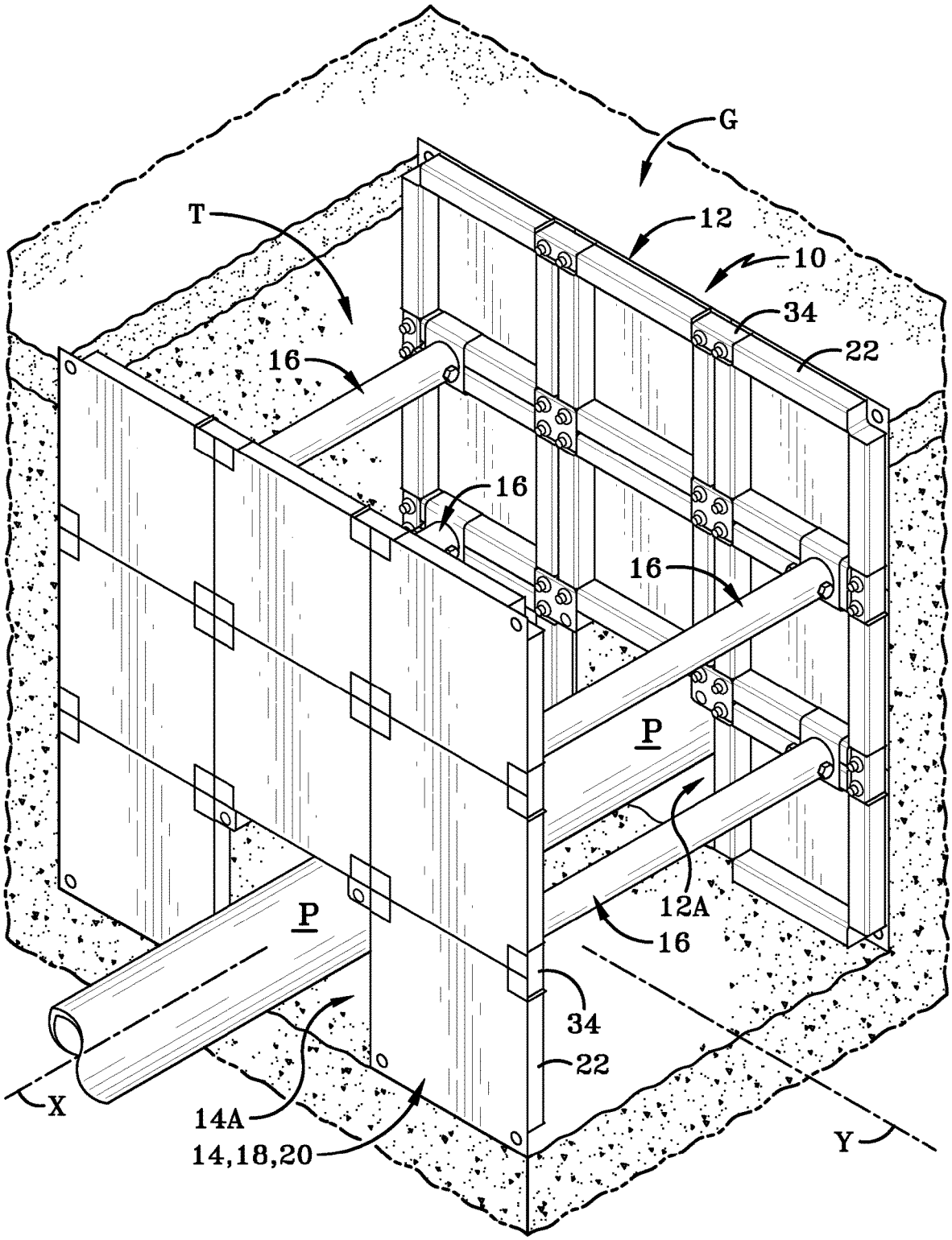
FIG. 14 is a top, front, left side isometric perspective view of the trench box of FIG. 13 shown installed in the ground and illustrating a pipe extending through openings formed in the opposed first plate and second plate through removal of panels therefrom.

FIGS. 13 and 14 illustrate a situation where a pipe "P" (FIG. 14) intersects trench "T" at a right angle. Since the placement of the trench box 10 is planned thoroughly before installation of trench box 10 into the ground "G", a decision is made that it is sufficiently safe enough for one panel 18 to be removed from each of the first plate 12 and second plate 14. Panel 18*g* is therefore removed from first plate 12, leaving a gap 12A defined therein. Panel 18*h* is removed from second plate 14, leaving a gap 14A defined therein. Panels 18*g*, 18*h* are readily removed by loosening the appropriate fastener(s) 32 and washers 30, and sliding the lug(s) on the panel being removed from the associated first connector 28 or second connector 34. The other panels which are going to remain as part of first plate 12 and second plate 14 remain secured to the respective first connector 28 or second connector 34. Trench box 10 is subsequently installed in the ground "G" and pipe "P" is permitted to pass through the gaps 12A and 14A in trench box 10.

After work in the trench "T" is completed, trench box 10 is removed from its installed position in the ground "G" and the panels 18*g* and 18*h* are secured once again into the associated first plate 12 or second plate 14 by reversing the steps outline above. This reengagement of the panels 18*g*, 18*h* is accomplished by sliding the lugs 26 on the respective panels 18*g*, 18*h* back through the appropriate apertures in the first connector 28 or second connector 34 from which they were previously removed and then reengaging the washers 30 and fasteners 32 to once again lock the previously-removed panels 18*g*, 18*h* into the respective one of the first plate 12 and second plate 14.

It will be understood that while both the first plate 12 and second plate 14 have been described and illustrated herein as being comprised of a plurality of modular panels which are detachably engaged with one another, in some embodiments one of the first plate and the second plate may, instead be comprised of a single sheet of metal. Utilizing a single sheet of metal for the plates of a trench box is known in the art but utilizing one plate fabricated from a plurality of detachably engaged modular panels and the other plate as a single metal sheet is not known in the art.

In summary, an exemplary embodiment of the present disclosure may provide a trench box 10 comprising a first plate 12, a second plate 14; and a plurality of spreader bars 16 extending between an interior surface of the first plate 12 and an interior surface of the second plate 14; wherein at least one of the first plate 12 and the second plate 14 is comprised of a plurality of modular panels 18 that are detachably engaged with one another. Trench box 10 further comprises a connector 28 configured to detachably secure four modular panels 18*a*, 18*b*, 18*c*, 18*d* of the plurality of modular panels to one another. Trench box 10 furthers comprise a second connector 34 configured to detachably secure two modular panels 18*e*, 18*f* of the plurality of modular panels 18 to one another. The plurality of modular panels 18 in first plate 12 are arranged in a first plane and the plurality of modular panels 18 in second plate 14 are arranged in a second plane. At least some of the plurality of modular panels 18 are arranged in side-by-side abutting contact to form a row of panels, such as the panels 18*a* and 18*b*. At least some of the plurality of modular panels 18 are arranged in end-to-end abutting contact to form a column of panels, such as panels 18*a* and 18*c*. One of the plurality of modular panels may be detached from a row of panels 18 to create an opening in the row of panels or one of the plurality of the modular panels 18 may be detached from a column of panels to create an opening in the column of panels. The remaining panels in the row or column including the opening remain engaged with one another. At least one of the first plate 12 and the second plate 14 having the opening in the row of panels or the column of panels remains sufficiently strong enough to resist collapse of an adjacent side wall of the trench "T".

Furthermore, the present disclosure relates to a modular panel assembly 18, 26, 28, 34 for use in assembling a side wall or plate 12 or 14 of a trench box 10. The modular panel assembly includes a modular panel 18 comprising a base plate 20 having an exterior surface 20*a* and an interior surface 20*b*. Exterior surface 20*a* is adapted to be disposed adjacent a side wall of a trench "T" and the interior surface 20*a* is adapted to be disposed remote from the side wall of the trench "T" and to face into the trench "T". The modular panel 18 also includes a frame 22 operatively engaged with one of the interior surface 20*b* and the exterior surface 20*a* of the base plate 20. The modular panel assembly may further comprise a plurality of lugs 26 extending away from the interior surface 20*b* of the base plate 20 wherein the plurality of lugs 26 are spaced a distance apart from one another. The modular panel assembly may further comprise a connector (such as first connector 28 and/or second connector 34), wherein at least two apertures (such as apertures 28*f*, 28*g*, 28*h*, 28*j*, 34*f*, and 34*g*) are defined in the connector 28 or 34 spaced a distance away from one another. A first aperture of the at least two apertures, for example aperture 34*f* may be located on the connector 34 so as to receive one of the plurality of the lugs 26 of a first modular panel therethrough, such as panel 18*e*, and a second aperture, such as 34*g* of the at least two apertures may be located on the connector 34 so as to receive one of a plurality of lugs 26 of an additional and adjacent modular panel therethrough, such as panel 18*f*. The connector 28 or 34, along with fasteners (30 & 32, for example) secures the first panel 18*e* and second panel 18*f* to one another in such a way that the two panels are in a same plane and are arranged in a column. Panels could, however, be secured together by the connector 28 or 34 to form a row within the ultimately assembled first plate 12 or second plate 14.

The present disclosure also relates to a method of forming a trench box 10 comprising providing a plurality of modular panels 18; providing a plurality of connectors 28, 34; connecting a first group of the plurality of modular panels 18 to one another with a first group of the plurality of connectors 28, 34 to form a first plate 12 of the trench box 10; connecting a second group of the plurality of modular panels 18 to one another with a second group of the plurality of connectors 28, 34 to form a second plate 14 of the trench box 10; extending a plurality of spreader bars 16 between an interior surface of the first plate 12 and an interior surface of the second plate 14. The disclosed method further comprises arranging the first group of the plurality of modular panels 18 in a same first plane prior to connecting the first group of the plurality of connectors 28, 34 thereto to form the first plate 12 of the trench box 10; and arranging the second group of the plurality of modular panels 18 in a same second plane that is different from the first plane prior to connecting the second group of the plurality of connectors 28, 34 thereto to form the second plate 14 of the trench box 10. When trench box 10 is ultimately assembled, the panels 18 in the first plane of the first plate 12 are arranged parallel to the panels 18 in the second plane of the second plate 14. The disclosed method further comprises extending one or more lugs 26 away from an interior surface 20*b* of each modular panel 18 of the plurality of modular panels; and engaging one of the plurality of connectors 28, 34 with a first lug of a first modular panel, such as 18*a*, and with a first lug of a second modular panel such as 18*b*. The first modular panel 18*a* and the second modular panel 18*b* are adjacent one another in a side-by-side configuration. In other instances, the first modular panel, such as 18*a* and the second modular panel, such as 18*c*, are arranged in an end-to-end configuration prior to being secured to one another by connectors 28, 34.

The disclosure furthermore relates to a method utilizing a trench box 10 to prevent sides of a trench "T" dug into the ground "G" from collapsing into the trench "T". The method includes assembling a first plate 12 from a plurality of modular panels 18 and a plurality of connectors 28, 34; assembling a second plate 14 from the plurality of modular panels 18 and the plurality of connectors 28, 34; fixing a plurality of spreader bars 16 between an interior surface of the first plate 12 and an interior surface of the second plate 14 to form the trench box 10. The method further includes digging the trench "T" in the ground "G" to perform a work operation therein, wherein the trench "T" extends in a first longitudinal direction "Y" (FIGS. 1 and 14) in the ground "G"; determining an obstacle, such as pipe "P" that extends across the trench "T" in a second direction "X" (FIG. 14). The second direction "X" is oriented at an angle to the first direction "Y", such as at 90° relative thereto. The method may further comprise removing one of the plurality of modular panels, such as panel 18*g*, from first plate 12 and/or removing a further one of the plurality of modular panels, such as panel 18*h* from second plate 14; and forming an opening such as opening 12A in first plate 12 and/or opening 14A in second plate 14. It will be understood that any one of the panels in either of the first plate 12 or second plate 14 may be determined to be in the way of the obstacle, pipe "P". When this determination is made the panel in the way of the obstacle is removed from the respective one of the first plate 12 and second plate 14. It may further be determined that the obstacle requires that a panel 18 in a mirrored location or a completely different location in the other plate needs to be removed as well in order for the obstacle to be avoided by trench box 10. So, for example, the center panel 18*g* in the bottom row may be removed from first plate 12, but the middle panel in the middle row, 18*j*, may need to be removed from second plate 14. In other words, an appropriate panel is removed from one or both of first plate 12 and second plate 14 to accommodate the obstacle.

The disclosed method further comprises lowering the trench box 10 into the trench "T" and supporting the sides of the trench "T" with first plate 12 and second plate 14, and thereby preventing collapse of the sides of the trench "T" into the trench itself. In the instance where a panel has been removed from first plate 12 and/or second plate 14, the method further comprises lowering the trench box 10 with the missing panels 18 into the trench "T", supporting the sides of the trench "T" with first plate 12 and second plate 14, and thereby preventing collapse of the sides of the trench "T" into the trench itself. In the latter instance, the disclosed method further comprises receiving the obstacle "P" in the opening 12A or 14A defined in the one of the first plate 12 and the second plate 14. The method includes supporting the first side and the second side of the trench "T" with the trench box; and preventing collapse of the first side of the trench "T" with the first plate 12 (whether that plate includes all panels 18 or has one or more panels removed therefrom) and preventing collapse of the second side of the trench "T" with the second plate (whether that plate includes all panels 18 or has one or more panels removed therefrom. The collapse is further prevented by maintaining the distance between the interior surface of first plate 12 and the interior surface of second plate 14 with spreader bars 16. It should be noted that more than one panel 18 may only be removed from first plate 12 or second plate 14 if these plates remain of a sufficient size and strength after the removal of the panels to support the adjacent side of the trench "T" and prevent collapse thereof.

The construction of the trench box 10 from modular panels 18 makes it easier for a contractor to transport the trench box 10 from a first location to a second location. The use of modular panels 18 also enables a contractor to assemble an appropriately sized trench box 10 in situ at the job site instead of having to arrange for differently sized trench boxes to be transported to the job site. The use of modular panels also enables the contractor to configure the trench box to avoid obstacles that may extend across the trench without comprising the structural integrity of the trench box. The ability to remove panels from the trench box reduces or avoids the need of a trench box to be removed from the ground to deal with the obstacle and then be replaced in the ground after the obstacle has been dealt with.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A trench box for installation in a trench, said trench box comprising:

a first plate;

a second plate;

a plurality of spreader bars extending between an interior surface of the first plate and an interior surface of the second plate;

wherein at least one of the first plate and the second plate is comprised of a plurality of modular panels that are detachably engaged with one another; and wherein a first connector is configured to detachably secure four modular panels of the plurality of modular panels to one another.

2. The trench box according to claim 1, further comprising a second connector configured to detachably secure two modular panels of the plurality of modular panels to one another.

3. The trench box according to claim 1, wherein the plurality of modular panels in the at least one of the first plate and the second plate are arranged in a same plane.

4. The trench box according to claim 1, wherein at least some of the plurality of modular panels are arranged in side-by-side abutting contact to form a row of panels or at least some of the plurality of modular panels are arranged in end-to-end abutting contact to form a column of panels.

5. The trench box according to claim 4, wherein one of the at least some of the plurality of modular panels is detachable from the row of panels to create an opening in the row of panels or one of the at least some of the plurality of modular panels is detachable from the column of panels to create an opening in the column of panels.

6. The trench box according to claim 5, wherein the at least one of the first plate and the second plate having the opening in the row of panels or the column of panels remains sufficiently strong enough to resist collapse of an adjacent side wall of the trench.

7. A modular panel assembly for use in assembling a side wall of a trench box; said modular panel assembly comprising:

a panel comprising:

a base plate having an interior surface and an exterior surface, wherein the exterior surface is adapted to be disposed adjacent a side wall of a trench and the interior surface is adapted to be disposed remote from the side wall and face into the trench;

a frame operatively engaged with one of the interior surface and the exterior surface of the base plate;

wherein the frame comprises at least two frame members; and at least one bracket extending between an end of adjacent frame members of the at least two frame members.

8. The modular panel assembly according to claim 7, further comprising a plurality of lugs extending away from the interior surface of the base plate, wherein the plurality of lugs are spaced a distance apart from one another.

9. The modular panel assembly according to claim 8, wherein at least one lug of the plurality of lugs is detachably engageable with the base plate.

10. The modular panel assembly according to claim 8, wherein at least one lug of the plurality of lugs is permanently secured to the base plate.

11. The modular panel assembly according to claim 8, further comprising a connector, wherein at least two apertures are defined in the connector spaced a distance away from one another, and wherein a first aperture of the at least two apertures is located on the connector to receive one of the plurality of lugs therethrough, and a second aperture of the at least two apertures is located on the connector to receive one of an additional plurality of lugs of an additional and adjacent panel therethrough.

12. A method of forming a trench box comprising:

providing a plurality of modular panels;

providing a plurality of connectors;

forming a first plate of the trench box by connecting a first group of at least four modular panels of the plurality of modular panels to one another with a first group of a first connector of the plurality of connectors and connecting a remainder of the first group of the plurality of modular panel to one another with the first group of the first connector or a first group of a second connector of the plurality of connectors;

forming a second plate of the trench box by connecting a second group of the plurality of modular panels to one another with a second group of the plurality of connectors; and extending a plurality of spreader bars between an interior surface of the first plate and an interior surface of the second plate.

13. The method according to claim 12, further comprising:

arranging the first group of the plurality of modular panels in a same first plane prior to connecting the first group of the plurality of connectors thereto to form the first plate of the trench box.

14. The method according to claim 12, further comprising:

arranging the second group of the plurality of modular panels in a same second plane prior to connecting the second group of the plurality of connectors thereto to form the second plate of the trench box.

15. The method according to claim 12, further comprising:

extending one or more lugs away from an interior surface of each modular panel of the plurality of modular panels; and engaging one of the plurality of connectors with a first lug of a first modular panel and with a first lug of a second modular panel, wherein the first modular panel and the second modular panel are adjacent one another in a side-by-side configuration or an end-to-end configuration.

16. The method according to claim 15, wherein extending one or more lugs away from the interior surface of each modular panel comprises permanently securing the one or more lugs to the interior surface of an associated modular panel.

17. The method according to claim 12, wherein forming the second plate further comprising:

connecting the second group of at least four modular panels of the plurality of modular panels to one another with the second group of the first connector of the plurality of connectors and connecting a remainder of the second group of the plurality of modular panel to one another with the second group of the first connector or a second group of the second connector of the plurality of connectors.

18. A method utilizing a trench box to prevent sides of a trench from collapsing into the trench, wherein the method comprises:

assembling a first plate by connecting a plurality of modular panels to one another with a plurality of connectors;

assembling a second plate by connecting the plurality of modular panels to one another with the plurality of connectors;

fixing a plurality of spreader bars between an interior surface of the first plate and an interior surface of the second plate to form a trench box;

digging a trench in a ground to perform a work operation therein, wherein the trench extends in a first direction in the ground;

determining an obstacle extends across the trench in a second direction, wherein the second direction is oriented at an angle to the first direction;

removing one of the plurality of modular panels from one of the first plate and the second plate by disconnecting at least one connector of the plurality of connectors from one of the plurality of modular panels; and forming an opening in the one of the first plate and the second plate where the removed one of the plurality of modular panels was previously located to accommodate the obstacle.

19. The method according to claim 18, further comprising:

lowering the trench box into the trench until the first plate is adjacent a first side of the trench and the second plate is adjacent a second side of the trench; and receiving the obstacle in the opening defined in the one of the first plate and the second plate.

20. The method according to claim 19, further comprising:

supporting the first side and the second side of the trench with the trench box; and preventing collapse of the first side of the trench with the first plate and preventing collapse of the second side of the trench with the second plate, and the plurality of spreader bars.

* * * * *